US011519061B2

(12) United States Patent
Okamoto et al.

(10) Patent No.: US 11,519,061 B2
(45) Date of Patent: Dec. 6, 2022

(54) STEEL SHEET

(71) Applicant: NIPPON STEEL & SUMITOMO METAL CORPORATION, Tokyo (JP)

(72) Inventors: Riki Okamoto, Tokyo (JP); Hiroyuki Kawata, Tokyo (JP); Masafumi Azuma, Tokyo (JP); Akihiro Uenishi, Tokyo (JP); Naoki Maruyama, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 252 days.

(21) Appl. No.: 15/751,113

(22) PCT Filed: Aug. 31, 2015

(86) PCT No.: PCT/JP2015/074638
§ 371 (c)(1),
(2) Date: Feb. 7, 2018

(87) PCT Pub. No.: WO2017/037827
PCT Pub. Date: Mar. 9, 2017

(65) Prior Publication Data

US 2018/0230581 A1 Aug. 16, 2018

(51) Int. Cl.
*C22C 38/58* (2006.01)
*C22C 38/12* (2006.01)
(Continued)

(52) U.S. Cl.
CPC ..... *C22C 38/58* (2013.01); *C21D 8/005* (2013.01); *C21D 8/1222* (2013.01);
(Continued)

(58) Field of Classification Search
CPC ..... C21D 2201/05; C21D 2211/002; C21D 2211/008; C22C 38/58
See application file for complete search history.

(56) References Cited

U.S. PATENT DOCUMENTS

2009/0098408 A1 4/2009 Sun
2011/0146852 A1* 6/2011 Matsuda ..... C21D 9/46 148/533
(Continued)

FOREIGN PATENT DOCUMENTS

CN 102149840 A 8/2011
EP 2325346 A1 5/2011
(Continued)

OTHER PUBLICATIONS

中川繁政． ホットストリップミルのラ ンアウトテーブルにおける鋼板冷却 制御に関する研究． Diss. 奈良先端科学技術大学院大学，2011 (Year: 2011).*
(Continued)

*Primary Examiner* — Anthony J Zimmer
*Assistant Examiner* — Sean P. O'Keefe
(74) *Attorney, Agent, or Firm* — Birch, Stewart, Kolasch & Birch, LLP

(57) ABSTRACT

A steel sheet includes: a predetermined chemical composition; and a steel structure represented by, in area %, first martensite in which two or more iron carbides each having a circle-equivalent diameter of 2 nm to 500 nm are contained in each lath: 20% to 95%, ferrite: 15% or less, retained austenite: 15% or less, and the balance: bainite, or second martensite in which less than two iron carbides each having a circle-equivalent diameter of 2 nm to 500 nm are contained in each lath, or the both of these, in which the total area fraction of ND//<111> orientation grains and ND//<100> orientation grains is 40% or less, and the content of solid-solution C is 0.44 ppm or more.

5 Claims, 2 Drawing Sheets

(51) Int. Cl.

| | |
|---|---|
| ***C21D 8/12*** | (2006.01) |
| ***C22C 38/08*** | (2006.01) |
| ***C22C 38/04*** | (2006.01) |
| ***C22C 38/14*** | (2006.01) |
| ***C22C 38/16*** | (2006.01) |
| ***C22C 38/02*** | (2006.01) |
| ***C22C 38/06*** | (2006.01) |
| ***C22C 38/34*** | (2006.01) |
| ***C22C 38/42*** | (2006.01) |
| ***C22C 38/44*** | (2006.01) |
| ***C21D 9/46*** | (2006.01) |
| ***C22C 38/00*** | (2006.01) |
| ***C23C 2/28*** | (2006.01) |
| ***C21D 8/00*** | (2006.01) |
| ***C23C 2/06*** | (2006.01) |
| ***C25D 7/06*** | (2006.01) |
| ***C25D 5/36*** | (2006.01) |
| ***C25D 5/48*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.

CPC ..... *C21D 8/1233* (2013.01); *C21D 8/1261* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C23C 2/06* (2013.01); *C23C 2/28* (2013.01); *C25D 5/36* (2013.01); *C25D 5/48* (2013.01); *C25D 7/0614* (2013.01); *C21D 2201/05* (2013.01); *C21D 2211/001* (2013.01); *C21D 2211/002* (2013.01); *C21D 2211/004* (2013.01); *C21D 2211/005* (2013.01); *C21D 2211/008* (2013.01)

(56) References Cited

U.S. PATENT DOCUMENTS

| | | | | |
|---|---|---|---|---|
| 2012/0103052 | A1 | 5/2012 | Ueoka et al. | |
| 2014/0103684 | A1 | 4/2014 | Takagi et al. | |
| 2014/0377584 | A1* | 12/2014 | Hasegawa ..... | C22C 38/002 148/533 |
| 2015/0017471 | A1 | 1/2015 | Shuto et al. | |
| 2016/0160310 | A1 | 6/2016 | Hasegawa et al. | |

FOREIGN PATENT DOCUMENTS

| | | | |
|---|---|---|---|
| JP | 10-237547 | A | 9/1998 |
| JP | 11-80878 | A | 3/1999 |
| JP | 11-80879 | A | 3/1999 |
| JP | 11-343535 | A | 12/1999 |
| JP | 2009-127089 | A | 6/2009 |
| JP | 2009-185355 | A | 8/2009 |
| JP | 2010-90432 | A | 4/2010 |
| JP | 2010-90475 | A | 4/2010 |
| JP | 2011-111672 | A | 6/2011 |
| JP | 2011-132602 | A | 7/2011 |
| JP | 2012-251239 | A | 12/2012 |
| JP | 2014-34716 | A | 2/2014 |
| JP | 2014-43629 | A | 3/2014 |
| JP | 2015-151576 | A | 8/2015 |
| JP | 2015-175050 | A | 10/2015 |
| KR | 10-2014-0074981 | A | 6/2014 |
| WO | WO 2009/048838 | A1 | 4/2009 |
| WO | WO 2010/114083 | A1 | 10/2010 |

OTHER PUBLICATIONS

International Search Report for PCT/JP2015/074638 (PCT/ISA/210) dated Nov. 24, 2015.

Written Opinion of the International Searching Authority for PCT/JP2015/074638 (PCT/ISA/237) dated Nov. 24, 2015.

Chinese Office Action and Search Report, dated Feb. 15, 2019, for corresponding Chinese Application No. 201580082469.7.

Notification of Transmittal of Translation of the International Preliminary Report on Patentability, International Preliminary Report on Patentability, Written Opinion of the International Searching Authority, issued in PCT/JP2015/074638, dated Mar. 15, 2018 (Forms PCT/IB/338, PCT/IB/373 and PCT/ISA/237).

Extended European Search Report for corresponding European Application No. 15902950.3, dated Apr. 12, 2019.

Korean Notification of Reason for Refusal for corresponding Korean Application No. 10-2018-7005083, dated Mar. 29, 2019, with English translation.

Korean Office Action for corresponding Korean Application No. 10-2018-7005083, dated Sep. 26, 2019.

* cited by examiner

STEEL SHEET

TECHNICAL FIELD

The present invention relates to a steel sheet capable of obtaining an excellent collision property suitable for an automobile member.

BACKGROUND ART

In the case of manufacturing an automotive vehicle body using a steel sheet, molding, welding, and coating and baking of the steel sheet are performed generally. Thus, the steel sheet for automobile is required to have excellent moldability and a high strength. As a steel sheet used for an automobile, conventionally, a dual phase (DP) steel sheet having a dual phase structure of ferrite and martensite and a transformation induced plasticity (TRIP) steel sheet have been cited. The steel sheets for automobile are also required to have excellent collision performance for the purpose of improving the safety of automobiles. That is, they are also required to be greatly plastically deformed when receiving an impact from the outside to absorb collision energy.

However, the DP steel sheet and the TRIP steel sheet have a problem that when they are subjected to punching, their collision property sometimes decreases. That is, each end face generated by punching (to be sometimes referred to as a "punched end face" hereinafter) becomes rough and cracking from the punched end face (to be sometimes referred to as "end face cracking" hereinafter) is likely to occur at the time of collision, resulting in failing to obtain a sufficient energy absorption amount and reaction force characteristic in some cases. The end face cracking sometimes decreases a fatigue property.

The DP steel sheet and the TRIP steel sheet have a property in which each yield strength improves by coating and baking, but the improvement in yield strength does not become sufficient, resulting in failing to obtain a sufficient reaction force characteristic in some cases.

CITATION LIST

Patent Literature

Patent Literature 1: Japanese Laid-open Patent Publication No. 2009-185355

Patent Literature 2: Japanese Laid-open Patent Publication No. 2011-111672

Patent Literature 3: Japanese Laid-open Patent Publication No. 2012-251239

Patent Literature 4: Japanese Laid-open Patent Publication No. 11-080878

Patent Literature 5: Japanese Laid-open Patent Publication No. 11-080879

Patent Literature 6: Japanese Laid-open Patent Publication No. 2011-132602

Patent Literature 7: Japanese Laid-open Patent Publication No. 2009-127089

Patent Literature 8: Japanese Laid-open Patent Publication No. 11-343535

Patent Literature 9: International Publication Pamphlet No. WO2010/114083

SUMMARY OF INVENTION

Technical Problem

An object of the present invention is to provide a steel sheet capable of suppressing end face cracking and capable of obtaining an excellent yield strength after coating and baking.

Solution to Problem

The present inventors conducted earnest examinations in order to solve the above-described problems. As a result, the following matters became clear.

(a) Solid-solution C contained in the steel sheet segregates to grain boundaries to strengthen the grain boundaries, and thus as the content of solid-solution C is larger, the roughness of the punched end face is more suppressed to obtain an excellent collision property, and an excellent post-coating and baking reaction force characteristic can be obtained.

(b) As the total area fraction of crystal grains having specific crystal orientations is smaller, the roughness of the punched end face is more suppressed to obtain an excellent collision property. The crystal grains having specific crystal orientations apply to crystal grains having a crystal orientation parallel to the normal direction (ND) of a sheet surface of the steel sheet being a crystal orientation having a deviation from the <111> direction of 10° or less (to be sometimes referred to as "ND//<111> orientation grains" hereinafter) and to crystal grains having a crystal orientation parallel to the normal direction of the sheet surface of the steel sheet being a crystal orientation having a deviation from the <100> direction of 10° or less (to be sometimes referred to as "ND//<100> orientation grains" hereinafter).

(c) Retained austenite causes embrittlement of the punched end face, and thus as the content of retained austenite is smaller, the roughness of the punched end face is more suppressed to obtain an excellent collision property.

As a result of further repeated earnest examinations based on such findings, the inventor of the present application devised the following various aspects of the invention.

(1)

A steel sheet includes:

a chemical composition represented by, in mass %,

C: 0.05% to 0.40%,

Si: 0.05% to 3.0%,

Mn: 1.5% to 3.5%,

Al: 1.5% or less,

N: 0.010% or less,

P: 0.10% or less,

S: 0.005% or less,

Nb: 0.00% to 0.04% or less,

Ti: 0.00% to 0.08% or less,

V and Ta: 0.0% to 0.3% in total,

Cr, Cu, Ni, Sn, and Mo: 0.0% to 1.0% in total,

B: 0.000% to 0.005%,

Ca: 0.000% to 0.005%,

Ce: 0.000% to 0.005%,

La: 0.000% to 0.005%, and the balance: Fe and impurities; and a steel structure represented by, in area %, first martensite in which two or more iron carbides each having a circle-equivalent diameter of 2 nm to 500 nm are contained in each lath: 20% to 95%, ferrite: 15% or less, retained austenite: 15% or less, and the balance: bainite, or second martensite in which less than two iron carbides each having a circle-equivalent diameter of 2 nm to 500 nm are contained in each lath, or the both of these, in which the total area fraction of ND//<111> orientation grains and ND//<100> orientation grains is 40% or less, the content of solid-solution C is 0.44 ppm or more, the ND//<111> orientation grain is a crystal grain having a crystal orientation parallel to the normal direction of a sheet surface being a crystal orientation having a deviation from the <111> direction of 10° or less, and the ND//<100> orientation grain is a crystal grain having a crystal orientation parallel to the normal direction of the sheet surface being a crystal orientation having a deviation from the <100> direction of 10° or less.

(2)

The steel sheet according to (1), in which in the chemical composition,

V and Ta: 0.01% to 0.3% in total is established.

(3)

The steel sheet according to (1) or (2), in which in the chemical composition,

Cr, Cu, Ni, Sn, and Mo: 0.1% to 1.0% in total is established.

(4)

The steel sheet according to any one of (1) to (3) in which in the chemical composition, B: 0.0003% to 0.005% is established.

(5)

The steel sheet according to any one of (1) to (5), in which in the chemical composition, Ca: 0.001% to 0.005%, Ce: 0.001% to 0.005%, La: 0.001% to 0.005%, or an arbitrary combination of these is established.

Advantageous Effects of Invention

According to the present invention, it is possible to suppress end face cracking and obtain an excellent yield strength after coating and baking because a chemical composition, a steel structure, area fractions of specific crystal grains, and the like are appropriate.

DESCRIPTION OF EMBODIMENTS

Figure 1:
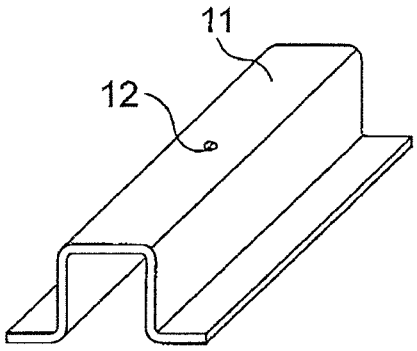
FIG. 1 is a view illustrating a hat-shaped part.
Figure 2:
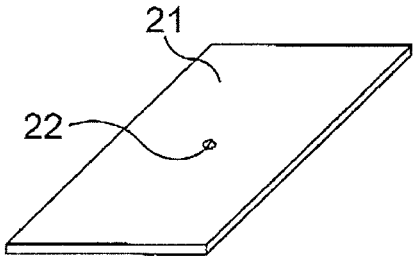
FIG. 2 is a view illustrating a lid.

Hereinafter, there will be explained an embodiment of the present invention.

First, there will be explained chemical compositions of the steel sheet according to the embodiment of the present invention and a steel to be used for its manufacture. Although its details will be described later, the steel sheet according to the embodiment of the present invention is manufactured by going through hot rolling, cold rolling, annealing, reheating, temper rolling, and so on of the steel. Thus, the chemical compositions of the steel sheet and the steel consider not only properties of the steel sheet, but also these treatments. In the following explanation, "%" being the unit of the content of each element contained in the steel sheet means "mass %" unless otherwise noted. The steel sheet according to this embodiment has a chemical composition represented by, in mass %, C: 0.05% to 0.40%, Si: 0.05% to 3.0%, Mn: 1.5% to 3.5%, Al: 1.5% or less, N: 0.010% or less, P: 0.10% or less, S: 0.005% or less, Nb: 0.00% to 0.04% or less, Ti: 0.00% to 0.08% or less, V and Ta: 0.0% to 0.3% in total, Cr, Cu, Ni, Sn, and Mo: 0.0% to 1.0% in total, B: 0.000% to 0.005%, Ca: 0.000% to 0.005%, Ce: 0.000% to 0.005%, La: 0.000% to 0.005%, and the balance: Fe and impurities. Examples of the impurities include ones contained in raw materials such as ore and scrap and ones contained in manufacturing steps.

(C: 0.05% to 0.40%)

C contributes to an improvement in tensile strength and solid-solution C segregates to grain boundaries to strengthen the grain boundaries. The strengthening of grain boundaries suppresses the roughness of a punched end face to obtain an excellent collision property. When the C content is less than 0.05%, it is impossible to obtain a sufficient tensile strength, for example, a tensile strength of 980 MPa or more, and solid-solution C falls short. Thus, the C content is 0.05% or more. The C content is preferably 0.08% or more so as to obtain a more excellent tensile strength and collision property. On the other hand, when the C content is greater than 0.40%, due to an increase in retained austenite and excessive precipitation of iron carbides, end face cracking becomes likely to occur at the time of collision. Thus, the C content is 0.40% or less. The C content is preferably 0.30% or less so as to obtain a more excellent collision property.

As described above, solid-solution C contained in the steel sheet segregates to grain boundaries to strengthen the grain boundaries. Therefore, as the content of solid-solution C is larger, the roughness of the punched end face is more suppressed to obtain an excellent collision property, and an excellent post-coating and baking reaction force characteristic can be obtained. When the content of solid-solution C contained in the steel sheet is less than 0.44 ppm, the punched end face becomes rough to fail to obtain a sufficient collision property and obtain a sufficient post-coating and baking reaction force characteristic. The reaction force characteristic after coating and baking can be evaluated based on an aging index (AI), and when the content of solid-solution C contained in the steel sheet is less than 0.44 ppm, it is impossible to obtain a desired aging index, for example, an aging index of 5 MPa or more. Thus, the content of solid-solution C is 0.44 ppm or more. Details of the aging index will be explained later.

(Si: 0.05% to 3.0%)

Si stabilizes austenite during annealing by suppressing generation of carbides, and contributes to securing of solid-solution C and suppression of generation of carbides on a grain boundary. When the Si content is less than 0.05%, it is impossible to obtain a sufficient tensile strength, and solid-solution C falls short and an increase in yield ratio by aging accompanying coating and baking falls short, resulting in failing to obtain a sufficient yield ratio, for example, a yield ratio of 0.8 or more. Thus, the Si content is 0.05% or more. The Si content is preferably 0.10% or more so as to obtain a more excellent tensile strength and collision property. On the other hand, when the Si content is greater than 3.0%, ferrite becomes excessive and retained austenite becomes excessive. Thus, the Si content is set to 3.0% or less. From the viewpoints of suppressing season cracking of a slab and suppressing end cracking during hot rolling, the Si content is preferably 2.5% or less and more preferably 2.0% or less.

(Mn: 1.5% to 3.5%)

Mn suppresses generation of ferrite. When the Mn content is less than 1.5%, ferrite is generated excessively and the end face cracking becomes likely to occur at the time of collision. Thus, the Mn content is 1.5% or more. The Mn content is preferably 2.0% or more so as to obtain a more excellent collision property. On the other hand, when the Mn content is greater than 3.5%, the total area fraction of ND//<111> orientation grains and ND//<100> orientation grains becomes excessive and the end face cracking becomes likely to occur at the time of collision. Thus, the Mn content is 3.5% or less. From the weldability viewpoint, the Mn content is preferably 3.0% or less.

(Al: 1.5% or Less)

Al is not an essential element, but is used for deoxidation intended for reducing inclusions, for example, and is able to remain in the steel. When the Al content is greater than 1.5%, ferrite is generated excessively and the end face cracking becomes likely to occur at the time of collision. Thus, the Al content is 1.5% or less. Reducing the Al content is expensive, and thus, when the Al content is tried to be reduced down to less than 0.002%, its cost increases significantly. Therefore, the Al content may be set to 0.002% or more. After sufficient deoxidation is performed, Al, which is 0.01% or more, sometimes remains.

(N: 0.010% or Less)

N is not an essential element, but is contained in the steel as an impurity, for example. When the N content is greater than 0.010%, it is impossible to obtain sufficient toughness, and thus the end face cracking becomes likely to occur at the time of collision and yield point elongation becomes excessive. Thus, the N content is 0.010% or less. From the moldability viewpoint, the N content is preferably 0.005% or less. Reducing the N content is expensive, and thus, when the N content is tried to be reduced down to less than 0.001%, its cost increases significantly. Therefore, the N content may be set to 0.001% or more.

(P: 0.10% or Less)

P is not an essential element, but is contained in the steel as an impurity, for example. When the P content is greater than 0.10%, the roughness of the punched end face becomes noticeable and the end face cracking becomes likely to occur at the time of collision. Thus, the P content is 0.10% or less. From the weldability viewpoint, the p content is preferably 0.05% or less. Reducing the P content is expensive, and thus, when the P content is tried to be reduced down to less than 0.001%, its cost increases significantly. Therefore, the P content may be set to 0.001% or more.

(S: 0.005% or Less)

S is not an essential element, but is contained in the steel as an impurity, for example. When the S content is greater than 0.005%, the roughness of the punched end face becomes noticeable and the end face cracking becomes likely to occur at the time of collision. Thus, the S content is 0.005% or less. The S content is preferably 0.003% or less so as to suppress cracking from a welded portion to occur at the time of collision. Reducing the S content is expensive, and thus, when the S content is tried to be reduced down to less than 0.0002%, its cost increases significantly. Therefore, the S content may be set to 0.0002% or more.

Nb, Ti, V, Ta, Cr, Cu, Ni, Sn, Mo, B, Ca, Ce, and La are not an essential element, but are an arbitrary element that may be appropriately contained, up to a predetermined amount as a limit, in the steel sheet and the steel.

(Nb: 0.00% to 0.04%, Ti: 0.00% to 0.08%)

Nb and Ti contribute to securing of solid-solution C and an improvement in yield strength by means of refining of crystal grains, and are effective for an improvement in collision property. Thus, Nb or Ti, or the both of these may be contained. However, when the Nb content is greater than 0.04%, the total area fraction of the ND//<111> orientation grains and the ND//<100> orientation grains becomes excessive and Nb carbonitrides precipitate excessively at grain boundaries, resulting in that the end face cracking becomes likely to occur at the time of collision. Thus, the Nb content is 0.04% or less. When the Ti content is greater than 0.08%, the total area fraction of the ND//<111> orientation grains and the ND//<100> orientation grains becomes excessive and Ti carbonitrides precipitate excessively at grain boundaries, resulting in that the end face cracking becomes likely to occur at the time of collision. Thus, the Ti content is 0.08% or less. The total content of Nb and Ti is preferably 0.01% or more so as to securely obtain an effect by the above-described functions. Incidentally, reducing the Nb content is expensive, and thus, when the Nb content is tried to be reduced down to less than 0.0002%, its cost increases significantly. Therefore, the Nb content may be set to 0.0002% or more. Reducing the Ti content is expensive, and thus, when the Ti content is tried to be reduced down to less than 0.0002%, its cost increases significantly. Therefore, the Ti content may be set to 0.0002% or more.

(V and Ta: 0.0% to 0.3% in Total)

V and Ta contribute to an improvement in strength by formation and grain refining of carbides, nitrides, or carbonitrides. Thus, V or Ta, or the both of these may be contained. However, when the total content of V and Ta is greater than 0.3%, carbides or carbonitrides in large amounts precipitate at grain boundaries and the roughness of the punched end face becomes noticeable, resulting in that the end face cracking becomes likely to occur at the time of collision. Thus, the total content of V and Ta is 0.3% or less. From the viewpoints of suppressing the season cracking of the slab and suppressing the end cracking during hot rolling, the total content of V and Ta is preferably 0.1% or less. The total content of V and Ta is preferably 0.01% or more so as to securely obtain an effect by the above-described functions.

(Cr, Cu, Ni, Sn, and Mo: 0.0% to 1.0% in Total)

Cr, Cu, Ni, Sn, and Mo suppress generation of ferrite, similarly to Mn. Thus, Cr, Cu, Ni, Sn, or Mo, or an arbitrary combination of these may be contained. However, when the total content of Cr, Cu, Ni, Sn, and Mo is greater than 1.0%, workability deteriorates significantly and the end face cracking is likely to occur. Thus, the total content of Cr, Cu, Ni, Sn, and Mo is 1.0% or less. From the viewpoint of more securely suppressing the end face cracking, the total content of Cr, Cu, Ni, Sn, and Mo is preferably 0.5% or less. The total content of Cr, Cu, Ni, Sn, and Mo is preferably 0.1% or more so as to securely obtain an effect by the above-described functions.

(B: 0.000% to 0.005%)

B increases hardenability of the steel sheet, suppresses formation of ferrite, and promotes formation of martensite. Thus, B may be contained. However, when the B content is greater than 0.005% in total, the end face cracking sometimes occurs at the time of collision. Thus, the B content is 0.005% or less. The B content is preferably 0.003% or less in total so as to obtain a more excellent collision property. The B content is preferably 0.0003% or more so as to securely obtain an effect by the above-described functions.

(Ca: 0.000% to 0.005%, Ce: 0.000% to 0.005%, La: 0.000% to 0.005%)

Ca, Ce, and La make oxides and sulfides in the steel sheet fine and change properties of oxides and sulfides, to thereby make the end face cracking difficult to occur. Thus, Ca, Ce, or La, or an arbitrary combination of these may be contained. However, when any one of the Ca content, the Ce content, and the La content is greater than 0.005%, an effect by the above-described functions is saturated and the cost increases needlessly, and at the same time, the moldability decreases. Thus, the Ca content, the Ce content, and the La content each are 0.005% or less. The Ca content, the Ce content, and the La content each are preferably 0.003% or less so as to more suppress the decrease in moldability. The Ca content, the Ce content, and the La content each are preferably 0.001% or more so as to securely obtain an effect by the above-described functions. That is, "Ca: 0.001% to 0.005%," "Ce: 0.001% to 0.005%," or "La: 0.001% to 0.005%," or an arbitrary combination of these is preferably satisfied.

Next, there will be explained a steel structure of the steel sheet according to the embodiment of the present invention. In the following explanation, "%" being the unit of a proportion of a phase or structure composing the steel structure means "area %" of an area fraction unless otherwise noted. The steel sheet according to the embodiment of the present invention has a steel structure represented by, in area %, 20% to 95% of first martensite in which two or more iron carbides each having a circle-equivalent diameter of 2 nm to 500 nm are contained in each lath, 15% or less of ferrite, 15% or less of retained austenite, and the balance composed of bainite, or second martensite in which less than two iron carbides each having a circle-equivalent diameter of 2 nm to 500 nm are contained in each lath, or the both of these.

(First Martensite in which Two or More Iron Carbides Each Having a Circle-Equivalent Diameter of 2 nm to 500 nm are Contained in Each Lath: 20% to 95%)

The first martensite in which two or more iron carbides each having a circle-equivalent diameter of 2 nm to 500 nm are contained in each lath contributes to an improvement in tensile strength and securing of solid-solution C, and by securing solid-solution C, the yield ratio improves by aging accompanying coating and baking and the end face cracking is suppressed at the time of collision. Iron carbides on a lath boundary do not apply to the iron carbides in each lath. Not only an iron carbide composed of Fe and Ca, but also an iron carbide containing other elements applies to the iron carbide. Examples of the other elements include Mn, Cr, and Mo.

Martensite in which iron carbides each having a circle-equivalent diameter of 2 nm or more do not exist in each lath and martensite in which less than two iron carbides each having a circle-equivalent diameter of 2 nm or more exist in each lath fail to sufficiently contribute to the improvement in tensile strength and the securing of solid-solution C. Martensite in which out of two or more existing iron carbides each having a circle-equivalent diameter of 2 nm or more, less than two iron carbides each having a circle-equivalent diameter of 500 nm or less exist in each lath causes excessive yield point elongation and blocks the improvement in tensile strength due to the effect of coarse iron carbides.

Then, when an area fraction of the first martensite is less than 20%, the yield ratio does not improve sufficiently even by the aging accompanying coating and baking. Thus, the area fraction of the first martensite is 20% or more. The area fraction of the first martensite is preferably 30% or more so as to obtain a higher yield ratio. On the other hand, when the area fraction of the first martensite is greater than 95%, ductility becomes short, and regardless of presence or absence of the punched end face, cracking from a portion deformed greatly at the time of collision is likely to occur. Thus, the area fraction of the first martensite is 95% or less. The area fraction of the first martensite is preferably 90% or less so as to obtain more excellent ductility.

(Ferrite: 15% or Less)

Ferrite improves moldability of the steel sheet, but makes the end face cracking occur easily at the time of collision, blocks the improvement in yield ratio by coating and baking, and reduces the reaction force characteristic. Then, when an area fraction of the ferrite is greater than 15%, the occurrence of the end face cracking, the blocking of the improvement in yield ratio, and the reduction in reaction force characteristic are significant. Thus, the area fraction of the ferrite is 15% or less. The area fraction of the ferrite is preferably 10% or less, and more preferably 6% or less so as to obtain a more excellent collision property.

(Retained Austenite: 15% or Less)

Retained austenite contributes to an improvement in moldability and absorption of impact energy, but embrittles the punched end face to make the end face cracking occur easily at the time of collision. Then, when an area fraction of the retained austenite is greater than 15%, the occurrence of the end face cracking is noticeable. Thus, the area fraction of the retained austenite is 15% or less. The area fraction of the retained austenite is preferably 12% or less so as to obtain a more excellent collision property. When the area fraction of the retained austenite is less than 3%, cracking from a stretched flange portion sometimes occurs at the time of collision. Thus, the area fraction of the retained austenite is preferably 3% or more.

(Balance: Bainite or Second Martensite in which Less than Two Iron Carbides Each Having a Circle-Equivalent Diameter of 2 nm to 500 nm are Contained in Each Lath, or the Both of these)

The balance other than the first martensite, the ferrite, and the retained austenite is bainite, second martensite, or the both of these. When bainite is contained, concentration of C is promoted to facilitate obtaining of 3% to 15% of retained austenite in area fraction.

In the present application, the ferrite includes polygonal ferrite ($\alpha p$), quasi-polygonal ferrite ($\alpha q$), and granular bainitic ferrite ($\alpha B$), and the bainite includes lower bainite, upper bainite, and bainitic ferrite ($\alpha^{\circ}$ B). The granular bainitic ferrite has a recovered dislocation substructure containing no laths, and the bainitic ferrite has a structure having no precipitation of carbides and containing bundles of laths, and prior $\gamma$ grain boundaries remain as they are (see Reference: "Atlas for Bainitic Microstructures-1" The Iron and Steel Institute of Japan (1992) p. 4). This reference includes the description "Granular bainitic ferrite structure; dislocated substructure but fairly recovered like lath-less" and the description "sheaf-like with laths but no carbide; conserving the prior austenite grain boundary."

Martensite in which iron carbides each having a circle-equivalent diameter of 2 nm or more do not exist in each lath, martensite in which less than two iron carbides each having a circle-equivalent diameter of 2 nm or more exist in each lath, and martensite in which out of two or more existing iron carbides each having a circle-equivalent diameter of 2 nm or more, less than two iron carbides each having a circle-equivalent diameter of 500 nm or less exist in each lath apply to the second martensite. When an area fraction of the second martensite is greater than 3%, a sufficient yield ratio sometimes cannot be obtained after coating and baking. Thus, the area fraction of the second martensite is preferably 3% or less.

Area ratios of ferrite, bainite, martensite, and pearlite can be measured by a point counting method or an image analysis while using a steel structure photograph taken by an optical microscope or a scanning electron microscopy (SEM), for example. Distinction between the granular bainitic ferrite (α B) and the bainitic ferrite (α° B) can be performed based on the descriptions of the above-described reference after a structure is observed by a SEM and a transmission electron microscope (TEM). The circle-equivalent diameter of the iron carbides in each martensite lath can be measured by observing a structure by a SEM and a TEM. The content of solid-solution C can be measured by an internal friction method, for example. The contents of the internal friction method are described in "J. Japan Inst. Met. Mater. (1962), vol, 26, (1), 47", for example.

The area fraction of the retained austenite can be measured by an electron backscatter diffraction (EBSD) method or an X-ray diffractometry, for example. In the case of measurement by the X-ray diffractometry, it is possible to calculate an area fraction of the retained austenite ($f_A$) from the following expression after measuring a diffraction intensity of the (111) plane of ferrite (α(111)), a diffraction intensity of the (200) plane of retained austenite (γ(200)), a diffraction intensity of the (211) plane of ferrite (α(211)), and a diffraction intensity of the (311) plane of retained austenite (γ (311)) by using a Mo-Kα line.

$$f_A=(2/3)\{100/(0.7\times\alpha(111)/\gamma(200)+1)\}+(1/3)\{100/(0.78\times\alpha(211)/\gamma(311)+1)\}$$

Next, the total area fraction of the ND//<111> orientation grains and the ND//<100> orientation grains in the steel steel according to the embodiment of the present invention will be explained. The present inventors found out that the total area fraction of the ND//<111> orientation grains and the ND//<100> orientation grains greatly affects the end face cracking to occur at the time of collision. That is, it was found out that in the case of this total area fraction being greater than 40%, the end face cracking is likely to occur at the time of collision. Thus, this total area fraction is 40% or less. Crystal orientations can be specified by the EBSD method. The total area fraction of the ND//<111> orientation grains and the ND//<100> orientation grains is the proportion to all crystal grains on an observation surface, and is distinguished from the area fraction of the steel structure. That is, their denominators are different between them, and the sum of them does not need to be 100%.

Next, there will be explained mechanical properties of the steel sheet according to the embodiment of the present invention.

The steel sheet according to this embodiment preferably has a tensile strength of 980 MPa or more. This is because in the case of the tensile strength being less than 980 MPa, it is difficult to obtain an advantage of a reduction in weight achieved by the strength of a member being increased.

The steel sheet according to this embodiment preferably has an aging index (AI) of 5 MPa or more and more preferably 10 MPa or more. This is because in the case of the aging index being less than 5 MPa, the yield ratio after coating and baking is low and it is difficult to obtain an excellent reaction force characteristic. The aging index mentioned here means the difference between a yield strength obtained after a 10%-tensile prestrain is applied and aging at 100° C. for 60 minutes is performed and a yield strength before the aging, and is equivalent to an increased amount of the yield strength resulting from the aging. The aging index is affected by the content of solid-solution C in the steel sheet.

The steel sheet according to this embodiment has a yield point elongation of 3% or less preferably, and 1% or less more preferably. This is because in the case of the yield point elongation being greater than 3%, the steel sheet is likely to be fractured as a local strain is concentrated at the time of molding and at the time of collision.

The steel sheet according to this embodiment has a yield ratio after aging accompanying coating and baking of 0.80 or more preferably and 0.88 or more more preferably. This is because in the case of the yield ratio after the aging being less than 0.80, it is impossible to obtain a sufficient collision property and it is difficult to obtain the advantage of a reduction in weight of a member. The yield ratio after the aging mentioned here is measured as follows. First, the steel sheet has a 5%-tensile prestrain applied thereto and is subjected to an aging treatment at 170° C. for 20 minutes, which is equivalent to the coating and baking. Thereafter, a tensile strength and a yield strength are obtained by a tensile test, and the yield ratio is calculated from these tensile strength and yield strength. The reason why the magnitude of the tensile prestrain is set to 5% is because it is considered that a molding strain of 5% or more is generally introduced into a bending portion and a drawing portion in the manufacture of an automobile frame member.

Next, there will be explained a method of manufacturing the steel sheet according to the embodiment of the present invention. In this manufacturing method, there are performed hot rolling, cold rolling, annealing, reheating, temper rolling, and so on of the steel having the above-described chemical composition.

First, a slab having the above-described chemical composition is manufactured to be subjected to hot rolling. The slab to be subjected to hot rolling can be manufactured by a continuous casting method, a blooming method, a thin slab caster, or the like, for example. Such a process as continuous casting-direct rolling in which hot rolling is performed immediately after casting may be employed.

In the hot rolling, rough rolling and finish rolling are performed. The finish rolling is started at a temperature of (960+(80×[% Nb]+40×[% Ti]))° C. or more. [% Nb] is the Ni content, and [% Ti] is the Ti content. When the temperature at which the finish rolling is started (finish rolling start temperature: HST) is less than (960+(80×[% Nb]+40×[% Ti]))° C., the total area fraction of the ND//<100> orientation grains and the ND//<111> orientation grains becomes excessive, the roughness of the punched end face becomes noticeable, and the end face cracking becomes likely to occur at the time of collision. The finish rolling is finished at a temperature of (880+(80×[% Nb]+40×[% Ti]))° C. or more. When the temperature at which the finish rolling is finished (finish rolling finishing temperature: HFT) is less than (880+(80×[% Nb]+40×[% Ti]))° C., the total area fraction of the ND//<100> orientation grains and the ND//<111> orientation grains becomes excessive, the roughness of the punched end face becomes noticeable, and the end face cracking becomes likely to occur at the time of collision. The finish rolling is preferably finished at a temperature of (890+(80×[% Nb]+40×[% Ti]))° C. or more.

After the finish rolling is finished, the steel sheet is cooled. In this cooling, a first average cooling rate (CR1) between the finish rolling finishing temperature (HFT) and (HFT−20° C.) is set to 10° C./s or less, and a second average cooling rate (CR2) between an $Ar_3$ point and 700° C. is set to 30°

C./s or more. When the first average cooling rate is greater than 10° C./s, the total area fraction of the ND//<100> orientation grains and the ND//<111> orientation grains becomes excessive, the roughness of the punched end face becomes noticeable, and the end face cracking becomes likely to occur at the time of collision. The first average cooling rate is preferably set to 8° C./s or less. When the second average cooling rate is less than 30° C./s, it is impossible to obtain sufficient solid-solution C after annealing, the yield ratio does not improve sufficiently even by the coating and baking, and the roughness of the punched end face becomes noticeable.

Coiling after the finish rolling is performed at 670° C. or less. When the coiling temperature (CT) is greater than 670° C., it is impossible to obtain sufficient solid-solution C after annealing, the yield ratio does not improve sufficiently even by the coating and baking, and the roughness of the punched end face becomes noticeable. The coiling temperature is preferably set to 620° C. or less.

After the coiling, pickling and cold rolling are performed. The cold rolling is performed at a reduction ratio of 75% or less. When the reduction ratio of the cold rolling is greater than 75%, the roughness of the punched end face becomes noticeable, and the end face cracking becomes likely to occur at the time of collision.

After the cold rolling, annealing is performed. When the maximum attained temperature (ST) of this annealing is less than $(Ac_3-60)$° C., the total area fraction of the ND//<100> orientation grains and the ND//<111> orientation grains becomes greater than 40%, and the area fraction of the ferrite becomes greater than 15%. As a result, the roughness of the punched end face becomes noticeable, and the end face cracking becomes likely to occur at the time of collision. Even when an annealing time period is less than three seconds, the roughness of the punched end face becomes noticeable, and the end face cracking becomes likely to occur at the time of collision due to the similar reason. Thus, the maximum attained temperature is set to $(Ac_3-60)$° C. or more, and a holding time period at the maximum attained temperature is set to three seconds or more. The maximum attained temperature is preferably set to $(Ac_3-40)$° C. or more in order to obtain a more excellent collision property. On the other hand, when the maximum attained temperature is greater than $(Ac_3-70)$° C., crystal grains become coarse to make the punched end face brittle, and the end face cracking becomes likely to occur at the time of collision. Thus, the maximum attained temperature is preferably set to $(Ac_3+70)$° C. For the annealing, for example, a continuous annealing line, or a continuous annealing line provided with a plating line is used.

The value of the transformation temperature $Ac_3$ (° C.) can be expressed by the following expression. [% C] is the C content, [% Si] is the Si content, [% Mn] is the Mn content, [% Cu] is the Cu content, [% Ni] is the Ni content, [% Cr] is the Cr content, [% Mo] is the Mo content, [% Ti] is the Ti content, [% Nb] is the Nb content, [% V] is the V content, and [% Al] is the Al content.

$$Ac_3(°\ C.)=937.2-436.5[\%\ C]+56[\%\ Si]-19.7[\%\ Mn]-16.3[\%\ Cu]-26.6[\%\ Ni]-4.9[\%\ Cr]+38.1[\%\ Mo]+136.3[\%\ Ti]-19.1[\%\ Nb]+124.8[\%\ V]+198.4[\%\ Al]$$

In cooling after the annealing, a third average cooling rate (CR3) between 700° C. and 500° C. is set to 10° C./s or more and a fourth average cooling rate (CR4) between 300° C. and 150° C. is set to 10° C./s or more. When the third average cooling rate is less than 10° C./s, the area fraction of the ferrite increases to greater than 15% and it becomes impossible to obtain sufficient solid-solution C, and therefore, the yield ratio does not improve sufficiently even by the coating and baking. The third average cooling rate is preferably set to 20° C./s or more. When the fourth average cooling rate is less than 10° C./s, it is impossible to obtain sufficient solid-solution C, and therefore, the yield ratio does not improve sufficiently even by the coating and baking.

Thereafter, reheating is performed for 10 seconds or more in a temperature zone of 300° C. or more and 530° C. or less. During this reheating, the iron carbides grow in the martensite lath. When this holding temperature (Tr) is less than 300° C., it is impossible to obtain sufficient iron carbides, the yield ratio does not improve sufficiently even by the coating and baking, the end face cracking is likely to occur at the time of collision, the absorption amount of energy is low, and it is impossible to obtain a sufficient reaction force characteristic. When the holding time period is less than 10 seconds, it is impossible to obtain an excellent collision property due to the similar reason. When the holding temperature is greater than 530° C., the iron carbides become coarse, the yield point elongation becomes excessive, and the tensile strength falls short.

During the reheating, a plating treatment may be performed on the steel sheet. The plating treatment may be performed in a plating line provided in a continuous annealing line, or performed in a line exclusive to plating, which is different from the continuous annealing line, for example. The composition of plating is not limited in particular. As the plating treatment, for example, a hot-dip plating treatment, an alloying hot-dip plating treatment, or an electroplating treatment can be performed.

After the reheating, temper rolling (skin pass rolling) is performed at an elongation ratio of 0.2% or more. When the elongation ratio is less than 0.2, the yield point elongation increases to greater than 3% to fail to obtain a sufficient reaction force characteristic. On the other hand, when the elongation ratio is greater than 2.0%, the moldability sometimes decreases. Thus, the elongation ratio is preferably set to 2.0% or less.

In this manner, it is possible to manufacture the steel sheet according to the embodiment of the present invention.

According to this embodiment, since the chemical composition, the steel structure, the area fractions of specific crystal grains, and the like are appropriate, it is possible to suppress the end face cracking and obtain an excellent yield strength after the coating and baking.

It should be noted that the above-described embodiment merely illustrates concrete examples of implementing the present invention, and the technical scope of the present invention is not to be construed in a restrictive manner by these. That is, the present invention may be implemented in various forms without departing from the technical spirit or main features thereof.

Example

Next, there will be explained examples of the present invention. Conditions of the examples are condition examples employed for confirming the applicability and effects of the present invention, and the present invention is not limited to these condition examples. The present invention can employ various conditions as long as the object of the present invention is achieved without departing from the spirit of the invention.

In this test, steels having chemical compositions illustrated in Table 1 were melted to manufacture steel billets, and these steel billets were heated to 1200° C. to 1250° C. to be subjected to hot rolling. In the hot rolling, rough rolling and finish rolling were performed. Each blank space in Table 1 indicates that the content of a corresponding element was less than a detection limit, and the balance is Fe and impurities. Each underline in Table 1 indicates that a corresponding numerical value is outside the range of the present invention.

TABLE 1

| STEEL SYMBOL | C | Si | Mn | Al | N | P | S | Ti | Nb | B | Cr | Mo | Cu | Ni | La | Ce | Ca | V | Ta | Sn |
|---|---|---|---|---|---|---|---|---|---|---|---|---|---|---|---|---|---|---|---|---|
| A | 0.19 | 1.1 | 2.2 | 0.03 | 0.002 | 0.01 | 0.002 | 0.02 | | | | | | | | | | | | |
| B | 0.21 | 1.5 | 2.4 | 0.03 | 0.002 | 0.01 | 0.002 | | 0.01 | | | | | | | | | | | |
| C | 0.14 | 0.3 | 2.5 | 0.03 | 0.002 | 0.01 | 0.002 | 0.01 | 0.02 | 0.002 | | | | | | | | | | |
| D | 0.15 | 0.7 | 2.6 | 0.03 | 0.002 | 0.01 | 0.002 | 0.04 | | 0.002 | 0.2 | | | | | | | | | |
| E | 0.28 | 1.4 | 2.0 | 0.20 | 0.002 | 0.01 | 0.002 | 0.02 | | | | 0.1 | 0.1 | 0.3 | | | | | | |
| F | 0.20 | 1.3 | 1.9 | 0.03 | 0.002 | 0.01 | 0.002 | 0.06 | 0.01 | | 0.4 | | | | 0.001 | 0.001 | | | | |
| G | 0.22 | 1.8 | 2.4 | 0.02 | 0.002 | 0.01 | 0.002 | | | | | | | | | | | 0.3 | | |
| H | 0.13 | 0.2 | 2.5 | 0.50 | 0.002 | 0.01 | 0.002 | 0.02 | 0.02 | 0.001 | | | 0.1 | 0.1 | | | 0.002 | | | |
| I | 0.11 | 0.8 | 2.6 | 0.03 | 0.002 | 0.01 | 0.002 | 0.03 | | | | 0.15 | | | | | | | 0.08 | |
| J | 0.21 | 1.3 | 2.3 | 0.03 | 0.002 | 0.01 | 0.002 | 0.01 | 0.02 | 0.001 | | | | 0.1 | | | | | | 0.1 |
| K | 0.04 | 1.3 | 2.3 | 0.03 | 0.002 | 0.01 | 0.002 | | 0.02 | | | | | | | | | | | |
| L | 0.41 | 1.3 | 2.3 | 0.03 | 0.002 | 0.01 | 0.002 | | 0.02 | | | | | | | | | | | |
| M | 0.21 | 0.01 | 2.3 | 0.03 | 0.002 | 0.01 | 0.002 | | 0.02 | | | | | | | | | | | |
| N | 0.21 | 3.2 | 2.3 | 0.03 | 0.002 | 0.01 | 0.002 | | 0.02 | | | | | | | | | | | |
| O | 0.21 | 1.3 | 1.3 | 0.03 | 0.002 | 0.01 | 0.002 | | 0.02 | | | | | | | | | | | |
| P | 0.21 | 1.3 | 3.9 | 0.03 | 0.002 | 0.01 | 0.002 | | 0.02 | | | | | | | | | | | |
| Q | 0.21 | 1.3 | 2.3 | 1.60 | 0.002 | 0.01 | 0.002 | | 0.02 | | | | | | | | | | | |
| R | 0.21 | 1.3 | 2.3 | 0.03 | 0.012 | 0.01 | 0.002 | | 0.02 | | | | | | | | | | | |
| S | 0.21 | 1.3 | 2.3 | 0.03 | 0.002 | 0.12 | 0.002 | | 0.02 | | | | | | | | | | | |
| T | 0.21 | 1.3 | 2.3 | 0.03 | 0.002 | 0.01 | 0.006 | | 0.02 | | | | | | | | | | | |
| U | 0.21 | 1.3 | 2.3 | 0.03 | 0.002 | 0.01 | 0.002 | 0.12 | 0.02 | | | | | | | | | | | |
| V | 0.21 | 1.3 | 2.3 | 0.03 | 0.002 | 0.01 | 0.002 | | 0.05 | | | | | | | | | | | |

Seven stands were used in the finish rolling, and an entry-side temperature of the first stand on the uppermost-stream side, namely the temperature immediately before rolling, and an exit-side temperature of the seventh stand on the downmost-stream side, namely the temperature immediately after rolling were measured. The entry-side temperature of the first stand corresponds to the finish rolling start temperature (HST) and the exit-side temperature of the seventh stand corresponds to the finish rolling finishing temperature (HFT). These are illustrated in Table 2.

Hot-rolled steel sheets were cooled after the finish rolling to be coiled. The first average cooling rate (CR1) between the finish rolling finishing temperature (HFT) and (HFT−20° C.), the second average cooling rate (CR2) between the $Ar_3$ point and 700° C., and the coiling temperature (CT) in these cooling and coiling are illustrated in Table 2.

After the coiling, pickling of the hot-rolled steel sheets was performed to remove scales. Thereafter, cold rolling was performed at a reduction ratio of 45% to 70%, and thereby cold-rolled steel sheets each having a thickness of 1.2 mm were obtained. Subsequently, annealing of the cold-rolled steel sheets was performed by using a continuous annealing line. The maximum attained temperature (ST), the third average cooling rate (CR3) between 700° C. and 500° C., and the fourth average cooling rate (CR4) between 300° C. and 150° C. in this annealing are illustrated in Table 2.

Next, the steel sheets cooled down to a temperature of 150° C. or less were reheated. The holding temperature (Tr) and the holding time period (tr) in this reheating are illustrated in Table 2. Thereafter, temper rolling (skin pass rolling) was performed. The elongation ratio (SP) in this temper rolling is illustrated in Table 2.

On some of the steel sheets, a hot-dip galvanizing treatment or an alloying hot-dip galvanizing treatment was performed during continuous annealing or after continuous annealing, and on another of the steel sheets, an electrogalvanizing treatment was performed after continuous annealing. Steel types corresponding to the plating treatments are illustrated in Table 2. In Table 2, "GI" indicates a hot-dip galvanized steel sheet obtained after the hot-dip galvanizing treatment was performed, "GA" indicates an alloyed hot-dip galvanized steel sheet obtained after the alloying hot-dip galvanizing treatment was performed, "EG" indicates an electrogalvanized steel sheet obtained after the electrogalvanizing treatment was performed, and "CR" indicates the cold-rolled steel sheet that was not subjected to a plating treatment. In Sample No. 30 and Sample No. 31, for example, the cooling at CR3 of 30° C./s, the hot-dip galvanizing treatment (GI) or the alloying hot-dip galvanizing treatment (GA), the cooling at CR4 of 15V/s, and the reheating were performed in this order.

TABLE 2

| SAMPLE No. | STEEL SYMBOL | STEEL TYPE | HST (° C.) | HFT (° C.) | CR1 (° C./s) | CR2 (° C./s) | CT (° C.) | ST (° C.) | CR3 (° C./s) | CR4 (° C./s) | Tr (° C.) | tr (s) | SP (%) |
|---|---|---|---|---|---|---|---|---|---|---|---|---|---|
| 1 | A | CR | 990 | 900 | 8 | 50 | 600 | 860 | 30 | 15 | 320 | 30 | 0.5 |
| 2 | A | CR | 960 | 880 | 8 | 50 | 600 | 860 | 30 | 15 | 320 | 30 | 0.5 |
| 3 | A | CR | 1050 | 960 | 8 | 50 | 600 | 860 | 30 | 15 | 320 | 30 | 0.5 |
| 4 | A | CR | 990 | 880 | 8 | 50 | 600 | 860 | 30 | 15 | 320 | 30 | 0.5 |
| 5 | A | CR | 990 | 960 | 15 | 50 | 600 | 860 | 30 | 15 | 320 | 30 | 0.5 |
| 6 | A | CR | 990 | 900 | 8 | 20 | 600 | 860 | 30 | 15 | 320 | 30 | 0.5 |
| 7 | A | CR | 990 | 900 | 8 | 50 | 680 | 860 | 30 | 15 | 320 | 30 | 0.5 |
| 8 | A | CR | 990 | 900 | 8 | 50 | 600 | 810 | 30 | 15 | 320 | 30 | 0.5 |
| 9 | A | CR | 990 | 900 | 8 | 50 | 600 | 860 | 5 | 15 | 320 | 30 | 0.5 |
| 10 | A | CR | 990 | 900 | 8 | 50 | 600 | 860 | 30 | 5 | 320 | 30 | 0.5 |
| 11 | A | CR | 990 | 900 | 8 | 50 | 600 | 860 | 30 | 15 | 120 | 30 | 0.5 |
| 12 | A | CR | 990 | 900 | 8 | 50 | 600 | 860 | 30 | 15 | 450 | 30 | 0.5 |
| 13 | A | CR | 990 | 900 | 8 | 50 | 600 | 860 | 30 | 15 | 320 | 7 | 0.5 |
| 14 | A | EG | 990 | 900 | 8 | 50 | 600 | 860 | 30 | 15 | 320 | 30 | 0.5 |
| 15 | A | CR | 990 | 900 | 8 | 50 | 600 | 880 | 150 | 15 | NONE | | 0.5 |
| 16 | B | CR | 1000 | 900 | 8 | 50 | 550 | 860 | 20 | 20 | 330 | 50 | 0.5 |
| 17 | C | GA | 1030 | 930 | 8 | 50 | 620 | 820 | 30 | 15 | 400 | 20 | 0.3 |
| 18 | C | GA | 1030 | 880 | 8 | 50 | 620 | 820 | 30 | 15 | 400 | 20 | 0.3 |
| 19 | C | GA | 990 | 880 | 8 | 50 | 620 | 820 | 30 | 15 | 400 | 20 | 0.3 |
| 20 | C | GA | 1030 | 930 | 15 | 50 | 620 | 820 | 30 | 15 | 400 | 20 | 0.3 |
| 21 | C | GA | 1030 | 930 | 8 | 20 | 620 | 820 | 30 | 15 | 400 | 20 | 0.3 |
| 22 | C | GA | 1030 | 930 | 8 | 50 | 720 | 820 | 30 | 15 | 400 | 20 | 0.3 |
| 23 | C | GA | 1030 | 930 | 8 | 50 | 620 | 770 | 30 | 15 | 400 | 20 | 0.3 |
| 24 | C | GA | 1030 | 930 | 8 | 50 | 620 | 820 | 5 | 15 | 400 | 20 | 0.3 |
| 25 | C | GA | 1030 | 930 | 8 | 50 | 620 | 830 | 30 | 5 | 400 | 20 | 0.3 |
| 26 | C | GA | 1030 | 930 | 8 | 50 | 620 | 830 | 30 | 15 | 50 | 20 | 0.3 |
| 27 | C | GA | 1030 | 930 | 8 | 50 | 620 | 830 | 30 | 15 | 400 | 5 | 0.3 |
| 28 | D | CR | 1000 | 910 | 8 | 50 | 600 | 840 | 30 | 15 | 300 | 30 | 0.5 |
| 29 | E | CR | 1000 | 910 | 8 | 50 | 600 | 870 | 30 | 15 | 300 | 30 | 0.5 |
| 30 | F | GI | 1000 | 910 | 8 | 50 | 600 | 870 | 30 | 15 | 300 | 30 | 0.5 |
| 31 | G | GA | 1000 | 910 | 8 | 50 | 600 | 900 | 30 | 15 | 300 | 30 | 0.5 |
| 32 | H | CR | 1020 | 920 | 8 | 50 | 600 | 900 | 30 | 15 | 300 | 30 | 0.5 |
| 33 | I | CR | 1000 | 910 | 8 | 50 | 600 | 860 | 30 | 15 | 300 | 30 | 0.5 |
| 34 | J | CR | 1020 | 920 | 8 | 50 | 600 | 850 | 30 | 15 | 300 | 30 | 0.5 |
| 35 | K | CR | 1000 | 910 | 8 | 50 | 600 | 890 | 30 | 15 | 300 | 30 | 0.5 |
| 36 | L | CR | 1000 | 910 | 8 | 50 | 600 | 820 | 30 | 15 | 300 | 30 | 0.5 |
| 37 | M | CR | 1000 | 910 | 8 | 50 | 600 | 810 | 30 | 15 | 300 | 30 | 0.5 |
| 38 | N | CR | 1000 | 910 | 8 | 50 | 600 | 850 | 30 | 15 | 300 | 30 | 0.5 |
| 39 | O | CR | 1000 | 910 | 8 | 50 | 600 | 840 | 30 | 15 | 300 | 30 | 0.5 |
| 40 | P | CR | 1000 | 910 | 8 | 50 | 600 | 820 | 30 | 15 | 300 | 30 | 0.5 |
| 41 | Q | CR | 1000 | 910 | 8 | 50 | 600 | 860 | 30 | 15 | 300 | 30 | 0.5 |
| 42 | R | CR | 1000 | 910 | 8 | 50 | 600 | 840 | 30 | 15 | 300 | 30 | 0.5 |
| 43 | S | CR | 1000 | 910 | 8 | 50 | 600 | 840 | 30 | 15 | 300 | 30 | 0.5 |
| 44 | T | CR | 1000 | 910 | 8 | 50 | 600 | 840 | 30 | 15 | 300 | 30 | 0.5 |
| 45 | U | CR | 1050 | 950 | 8 | 50 | 600 | 860 | 30 | 15 | 300 | 30 | 0.5 |
| 46 | V | CR | 1020 | 920 | 8 | 50 | 600 | 840 | 30 | 15 | 300 | 30 | 0.5 |

In this manner, steel sheet samples were fabricated. Each underline in Table 2 indicates that a corresponding numerical value is outside an appropriate range of the manufacturing condition. Then, each steel structure of the samples was observed. In the steel structure observation, the area fraction ($f_F$) of the ferrite, the area fraction ($f_{MF}$) of the first martensite, and the area fraction ($f_A$) of the retained austenite were measured, and types of structures other than these were specified. In this observation, each ¼ thickness portion of the steel sheets was analyzed by a point counting method or an image analysis using an optical micrograph or a SEM photograph, or an X-ray diffractometry. The structure, which was difficult to be distinguished by the optical micrograph and the SEM photograph, was distinguished based on the descriptions of the reference by performing a TEM observation and specifying crystal orientations by the EBSD method. The circle-equivalent diameter of iron carbides was measured by a SEM observation, and the circle-equivalent diameter of minute iron carbides, which were difficult to be distinguished by the SEM observation, was measured by the TEM observation.

The measurement of the total area fraction of the ND//<100> orientation grains and the ND//<111> orientation grains was also performed. In this measurement, an analysis of a region with an area of 5000 $\mu m^2$ or more ranging from the ¼ position to the ½ position of the sheet thickness in a cross section including the rolling direction (RD) and the normal direction (ND) of the sheet surface was performed by the EBSD method. Further, the content of solid-solution C was measured by the internal friction method.

These results are illustrated in Table 3. Each underline in Table 3 indicates that a corresponding numerical value is outside the range of the present invention. In the space of "other structure" in Table 3, "B" indicates bainite, indicates pearlite, and "M" indicates second martensite.

TABLE 3

| SAMPLE No. | STEEL SYMBOL | STEEL TYPE | $f_F$ (%) | $f_M$ (%) | $f_A$ (%) | OTHER STRUCTURE | AREA FRACTION OF SPECIFIC CRYSTAL GRAIN (AREA % ) | SOLID-SOLUTION C (MASS %) | NOTE |
|---|---|---|---|---|---|---|---|---|---|
| 1 | A | CR | 5 | 45 | 10 | B | 32 | 1.19 | INVENTION EXAMPLE |
| 2 | A | CR | 5 | 45 | 10 | B | 48 | 1.19 | COMPARATIVE EXAMPLE |
| 3 | A | CR | 5 | 45 | 10 | B | 25 | 1.19 | INVENTION EXAMPLE |
| 4 | A | CR | 5 | 45 | 10 | B | 44 | 1.19 | COMPARATIVE EXAMPLE |
| 5 | A | CR | 5 | 45 | 10 | B | 42 | 1.19 | COMPARATIVE EXAMPLE |
| 6 | A | CR | 5 | 45 | 10 | B | 32 | 0.40 | COMPARATIVE EXAMPLE |
| 7 | A | CR | 5 | 45 | 10 | B | 32 | 0.41 | COMPARATIVE EXAMPLE |
| 8 | A | CR | 30 | 35 | 10 | B | 42 | 0.63 | COMPARATIVE EXAMPLE |
| 9 | A | CR | 25 | 35 | 10 | B | 32 | 0.41 | COMPARATIVE EXAMPLE |
| 10 | A | CR | 5 | 45 | 10 | B | 32 | 0.40 | COMPARATIVE EXAMPLE |
| 11 | A | CR | 5 | 15 | 10 | B, M | 32 | 1.19 | COMPARATIVE EXAMPLE |
| 12 | A | CR | 5 | 45 | 10 | B | 32 | 1.58 | INVENTION EXAMPLE |
| 13 | A | CR | 5 | 18 | 10 | B, M | 32 | 1.19 | COMPARATIVE EXAMPLE |
| 14 | A | EG | 5 | 45 | 10 | B | 32 | 1.19 | INVENTION EXAMPLE |
| 15 | A | CR | 0 | 98 | 2 | | 33 | 2.81 | COMPARATIVE EXAMPLE |
| 16 | B | CR | 3 | 60 | 10 | B | 30 | 1.89 | INVENTION EXAMPLE |
| 17 | C | GA | 5 | 80 | 3 | B, M | 32 | 1.89 | INVENTION EXAMPLE |
| 18 | C | GA | 5 | 80 | 3 | B, M | 44 | 1.89 | COMPARATIVE EXAMPLE |
| 19 | C | GA | 5 | 80 | 3 | B, M | 48 | 1.89 | COMPARATIVE EXAMPLE |
| 20 | C | GA | 5 | 80 | 3 | B, M | 42 | 1.89 | COMPARATIVE EXAMPLE |
| 21 | C | GA | 5 | 80 | 3 | B, M | 32 | 0.41 | COMPARATIVE EXAMPLE |
| 22 | C | GA | 5 | 80 | 3 | B, M | 32 | 0.39 | COMPARATIVE EXAMPLE |
| 23 | C | GA | 32 | 45 | 3 | B | 42 | 1.89 | COMPARATIVE EXAMPLE |
| 24 | C | GA | 37 | 40 | 3 | B | 32 | 0.41 | COMPARATIVE EXAMPLE |
| 25 | C | GA | 5 | 80 | 3 | B, M | 32 | 0.40 | COMPARATIVE EXAMPLE |
| 26 | C | GA | 5 | 5 | 3 | B, M | 32 | 1.89 | COMPARATIVE EXAMPLE |
| 27 | C | GA | 5 | 15 | 3 | B, M | 32 | 1.89 | COMPARATIVE EXAMPLE |
| 28 | D | CR | 6 | 45 | 4 | B, M | 36 | 1.58 | INVENTION EXAMPLE |
| 29 | E | CR | 5 | 35 | 14 | B | 32 | 1.19 | INVENTION EXAMPLE |
| 30 | F | GI | 3 | 50 | 12 | B | 37 | 0.87 | INVENTION EXAMPLE |
| 31 | G | GA | 4 | 40 | 12 | B | 31 | 0.97 | INVENTION EXAMPLE |
| 32 | H | CR | 5 | 90 | 3 | B | 30 | 1.58 | INVENTION EXAMPLE |
| 33 | I | CR | 6 | 70 | 2 | B | 37 | 1.58 | INVENTION EXAMPLE |
| 34 | J | CR | 5 | 35 | 8 | B | 32 | 2.23 | INVENTION EXAMPLE |
| 35 | K | CR | 3 | 40 | 2 | B | 32 | 0.52 | COMPARATIVE EXAMPLE |
| 36 | L | CR | 2 | 75 | 18 | B | 32 | 1.31 | COMPARATIVE EXAMPLE |
| 37 | M | CR | 8 | 70 | 0 | B | 32 | 0.41 | COMPARATIVE EXAMPLE |
| 38 | N | CR | 40 | 20 | 16 | B | 32 | 1.19 | COMPARATIVE EXAMPLE |
| 39 | O | CR | 20 | 35 | 5 | B, P | 32 | 0.87 | COMPARATIVE EXAMPLE |
| 40 | P | CR | 2 | 98 | 1 | B | 42 | 1.31 | COMPARATIVE EXAMPLE |
| 41 | Q | CR | 40 | 25 | 7 | B | 34 | 1.31 | COMPARATIVE EXAMPLE |
| 42 | R | CR | 5 | 35 | 8 | B | 32 | 2.23 | COMPARATIVE EXAMPLE |
| 43 | S | CR | 5 | 35 | 8 | B | 32 | 2.23 | COMPARATIVE EXAMPLE |
| 44 | T | CR | 5 | 35 | 8 | B | 32 | 2.23 | COMPARATIVE EXAMPLE |
| 45 | U | CR | 4 | 40 | 11 | B | 45 | 0.57 | COMPARATIVE EXAMPLE |
| 46 | V | CR | 4 | 40 | 8 | B | 42 | 0.52 | COMPARATIVE EXAMPLE |

Thereafter, each of the samples was subjected to a tensile test in conformity with JIS Z 2241. In this tensile test, a tensile test piece in conformity with JIS Z 2201 with its sheet width direction (direction perpendicular to the rolling direction) set to a longitudinal direction was used. Then, on each of the samples, a yield strength YS, a tensile strength TS, a yield point elongation YPE, and a uniform elongation uEl were measured. In this tensile strength test, a tensile test piece obtained by having a 5%-tensile prestrain applied thereto and then being subjected to an aging treatment at 170° C. for 20 minutes was also prepared for each of the samples, and the yield strength YS after aging and the tensile strength TS after aging were measured to calculate a yield ratio YR after aging.

On each of the samples, an aging index AI was measured. In the measurement of the aging index AI, a 10%-tensile prestrain was applied, aging was performed at 100° C. for 60 minutes, and then the yield strength was measured by the tensile test. The yield strength was also measured by the tensile test before the above-described aging, and an increased amount of the yield strength after the aging was calculated from the yield strength before the aging.

Figure 3:
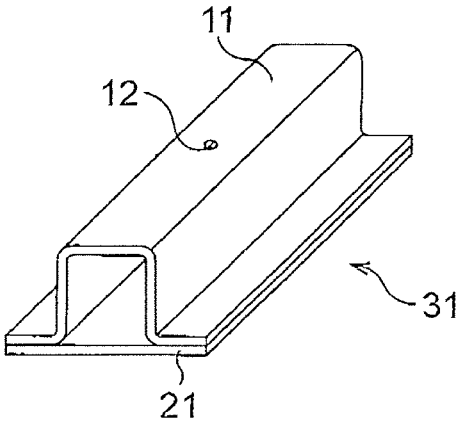
FIG. 3 is a view illustrating a test object.
Figure 4:
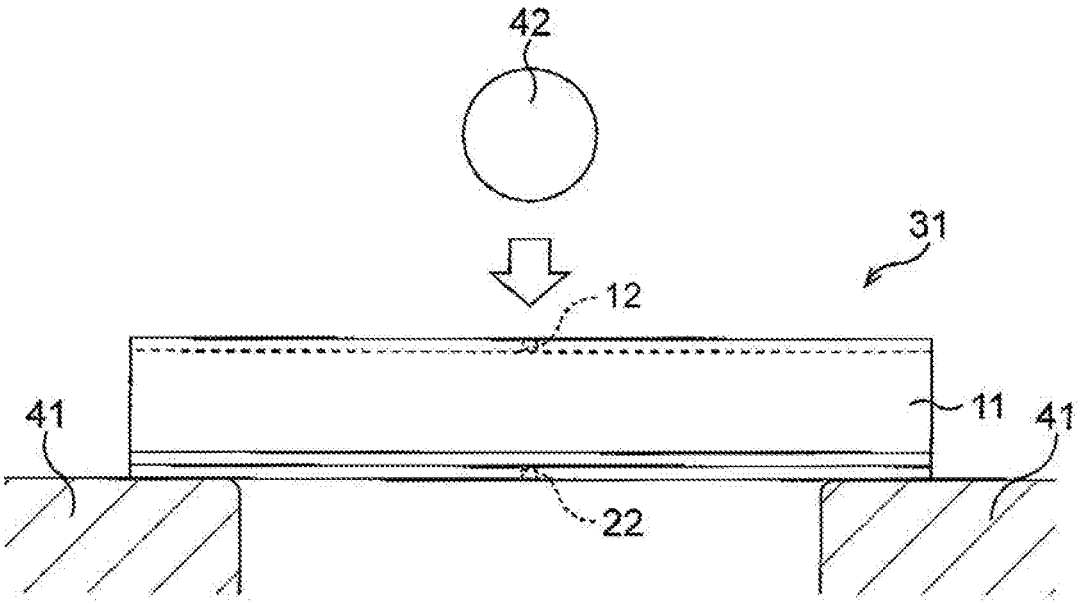
FIG. 4 is a view illustrating a method of evaluating ease of cracking of a sample.

Ease of cracking of each of the samples was evaluated. FIG. 1 to FIG. 4 are views each illustrating a method of evaluating the ease of cracking. In this evaluation, a hat-shaped part 11 illustrated in FIG. 1 and a lid 21 illustrated in FIG. 2 were first prepared. Each length in the longitudinal direction of the hat-shaped part 11 and lid 21 was set to 900 mm. The length in the width direction of the lid 21 was set to 100 mm. The height from a top portion of the hat-shaped part 11 was set to 50 mm, the length in the width direction was set to 50 mm, each length in the width direction of two flange portions was set to 25 mm, and the curvature radius of a curved portion was set to 5 mm. A hole 12 having a diameter of 10 mm was formed in the center of the hat-shaped part 11, and a hole 22 having a diameter of 10 mm was formed in the center of the lid 21. The hole 12 and the hole 22 each were formed by punching with a clearance of 15%. The hole 12 was formed before the hat-shaped part 11 was molded. Then, as illustrated in FIG. 3, the flange portions of the hat-shaped part 11 and the lid 21 were overlaid and these were welded by spot welding to obtain a test object 31. Thereafter, as illustrated in FIG. 4, on stands 41 provided with a space formed therebetween, the test object 31 was placed with the hole 12 positioned on an upper surface and the hole 22 positioned on a lower surface. The size of the space in the longitudinal direction of the test object 31 is 700 mm. Then, a cylindrical weight 42 having a weight of 500 kg was dropped down to a center portion of the test object 31 from the height of 3 m, to then confirm the presence/absence of cracking from the hole 12 and cracking from the hole 22.

These results are illustrated in Table 4. Each underline in Table 4 indicates that a corresponding numerical value is outside a target range.

TABLE 4

| SAMPLE No. | YS (MPa) | TS (MPa) | YPE (%) | uEI (%) | AI (MPa) | YS AFTER AGING (MPa) | TS AFTER AGING (MPa) | YR AFTER AGING | CRACKING | NOTE |
|---|---|---|---|---|---|---|---|---|---|---|
| 1 | 750 | 1090 | 0 | 13 | 15 | 1010 | 1100 | 0.92 | NONE | INVENTION EXAMPLE |
| 2 | 740 | 1090 | 0 | 13 | 15 | 1000 | 1090 | 0.92 | PRESENT | COMPARATIVE EXAMPLE |
| 3 | 760 | 1090 | 0 | 13 | 15 | 1020 | 1090 | 0.94 | NONE | INVENTION EXAMPLE |
| 4 | 730 | 1090 | 0 | 13 | 15 | 1000 | 1100 | 0.91 | PRESENT | COMPARATIVE EXAMPLE |
| 5 | 750 | 1080 | 0 | 14 | 15 | 1020 | 1080 | 0.94 | PRESENT | COMPARATIVE EXAMPLE |
| 6 | 730 | 1080 | 0 | 13 | 3 | 840 | 1080 | 0.78 | NONE | COMPARATIVE EXAMPLE |
| 7 | 730 | 1120 | 0 | 12 | 4 | 860 | 1120 | 0.77 | NONE | COMPARATIVE EXAMPLE |
| 8 | 650 | 1000 | 0 | 16 | 9 | 810 | 1020 | 0.79 | PRESENT | COMPARATIVE EXAMPLE |
| 9 | 680 | 1030 | 0 | 15 | 4 | 820 | 1040 | 0.79 | PRESENT | COMPARATIVE EXAMPLE |
| 10 | 750 | 1090 | 0 | 13 | 3 | 870 | 1100 | 0.79 | PRESENT | COMPARATIVE EXAMPLE |
| 11 | 680 | 1130 | 0 | 13 | 15 | 870 | 1140 | 0.76 | PRESENT | COMPARATIVE EXAMPLE |
| 12 | 840 | 1020 | 1 | 15 | 18 | 990 | 1020 | 0.97 | NONE | INVENTION EXAMPLE |
| 13 | 680 | 1130 | 0 | 13 | 15 | 860 | 1140 | 0.75 | PRESENT | COMPARATIVE EXAMPLE |
| 14 | 750 | 1090 | 0 | 13 | 15 | 1000 | 1100 | 0.91 | NONE | INVENTION EXAMPLE |
| 15 | 620 | 1180 | 0 | 10 | 25 | 880 | 1180 | 0.75 | PRESENT | COMPARATIVE EXAMPLE |
| 16 | 860 | 1270 | 0 | 9 | 20 | 1100 | 1270 | 0.87 | NONE | INVENTION EXAMPLE |
| 17 | 840 | 1090 | 0 | 6 | 20 | 1050 | 1090 | 0.96 | NONE | INVENTION EXAMPLE |
| 18 | 840 | 1100 | 0 | 6 | 20 | 1060 | 1110 | 0.95 | PRESENT | COMPARATIVE EXAMPLE |
| 19 | 840 | 1100 | 0 | 6 | 20 | 1040 | 1100 | 0.95 | PRESENT | COMPARATIVE EXAMPLE |
| 20 | 840 | 1100 | 0 | 6 | 20 | 1040 | 1110 | 0.94 | PRESENT | COMPARATIVE EXAMPLE |
| 21 | 830 | 1090 | 0 | 6 | 4 | 880 | 1110 | 0.79 | NONE | COMPARATIVE EXAMPLE |
| 22 | 820 | 1060 | 0 | 6 | 2 | 850 | 1090 | 0.78 | NONE | COMPARATIVE EXAMPLE |
| 23 | 720 | 1110 | 0 | 6 | 20 | 870 | 1110 | 0.78 | PRESENT | COMPARATIVE EXAMPLE |
| 24 | 700 | 1090 | 0 | 6 | 4 | 870 | 1120 | 0.78 | PRESENT | COMPARATIVE EXAMPLE |
| 25 | 840 | 1110 | 0 | 6 | 3 | 880 | 1110 | 0.79 | PRESENT | COMPARATIVE EXAMPLE |
| 26 | 700 | 1100 | 0 | 6 | 20 | 880 | 1120 | 0.79 | PRESENT | COMPARATIVE EXAMPLE |
| 27 | 740 | 1100 | 0 | 6 | 20 | 880 | 1110 | 0.79 | PRESENT | COMPARATIVE EXAMPLE |
| 28 | 780 | 1250 | 0 | 6 | 18 | 1120 | 1260 | 0.89 | NONE | INVENTION EXAMPLE |
| 29 | 830 | 1470 | 0 | 15 | 15 | 1310 | 1480 | 0.89 | NONE | INVENTION EXAMPLE |
| 30 | 830 | 1080 | 0 | 14 | 12 | 990 | 1080 | 0.92 | NONE | INVENTION EXAMPLE |
| 31 | 810 | 1120 | 0 | 15 | 13 | 1000 | 1120 | 0.89 | NONE | INVENTION EXAMPLE |
| 32 | 850 | 1030 | 0 | 8 | 18 | 990 | 1040 | 0.95 | NONE | INVENTION EXAMPLE |
| 33 | 740 | 1050 | 0 | 7 | 18 | 950 | 1050 | 0.90 | NONE | INVENTION EXAMPLE |
| 34 | 810 | 1040 | 0 | 13 | 22 | 940 | 1040 | 0.90 | NONE | INVENTION EXAMPLE |
| 35 | 620 | 880 | 0 | 11 | 7 | 800 | 890 | 0.90 | NONE | COMPARATIVE EXAMPLE |
| 36 | 1090 | 1500 | 0 | 17 | 16 | 1370 | 1500 | 0.91 | PRESENT | COMPARATIVE EXAMPLE |
| 37 | 660 | 970 | 0 | 9 | 4 | 770 | 970 | 0.79 | NONE | COMPARATIVE EXAMPLE |
| 38 | 560 | 1240 | 0 | 13 | 15 | 900 | 1240 | 0.73 | PRESENT | COMPARATIVE EXAMPLE |
| 39 | 600 | 980 | 0 | 8 | 12 | 780 | 990 | 0.79 | PRESENT | COMPARATIVE EXAMPLE |
| 40 | 1040 | 1390 | 0 | 5 | 16 | 1290 | 1390 | 0.93 | PRESENT | COMPARATIVE EXAMPLE |
| 41 | 530 | 1200 | 0 | 10 | 16 | 890 | 1200 | 0.74 | NONE | COMPARATIVE EXAMPLE |
| 42 | 830 | 1060 | 4 | 11 | 22 | 970 | 1070 | 0.91 | PRESENT | COMPARATIVE EXAMPLE |
| 43 | 810 | 1050 | 0 | 13 | 22 | 940 | 1050 | 0.90 | PRESENT | COMPARATIVE EXAMPLE |
| 44 | 810 | 1040 | 0 | 13 | 22 | 940 | 1040 | 0.90 | PRESENT | COMPARATIVE EXAMPLE |
| 45 | 810 | 1120 | 0 | 15 | 8 | 950 | 1120 | 0.85 | PRESENT | COMPARATIVE EXAMPLE |
| 46 | 780 | 1100 | 0 | 14 | 7 | 950 | 1100 | 0.86 | PRESENT | COMPARATIVE EXAMPLE |

As illustrated in Table 4, Samples No. 1, No. 3, No. 12, No. 14, No. 16, No. 17, and No. 28 to 34 each being an invention example, include the requirements of the present invention, and thus exhibit excellent properties.

In Samples No. 2, No. 4, No. 5, and No. 18 to No. 20, because of the total area fraction of the ND//<111> orientation grains and the ND//<100> orientation grains being excessive, the end face cracking occurred due to the effect of impact. In Samples No. 6, No. 7, No. 10, No. 21, No. 22, and No. 25, because of the content of solid-solution C being too small, the yield strength did not increase very much even by the aging to fail to obtain a sufficient yield ratio after the aging. In Sample No. 8, the area fraction of the ferrite was excessive and the total area fraction of the ND//<111> orientation grains and the ND//<100> orientation grains was excessive, to thus fail to obtain a sufficient yield ratio after the aging, and the end face cracking occurred due to the effect of impact. In Samples No. 9 and No. 24, the area fraction of the ferrite was excessive, to thus fail to obtain a sufficient yield ratio after the aging, and the end face cracking occurred due to the effect of impact. Further, because of the content of solid-solution C being too small, the yield strength did not increase very much even by the aging to fail to obtain a sufficient yield ratio after the aging. In Samples No. 11, No. 13, No. 26, and No. 27, the area fraction of the first martensite was too small, to thus fail to obtain a sufficient yield ratio after the aging, and the end face cracking occurred due to the effect of impact. In Sample No. 15, the area fraction of the first martensite was excessive, to thus fail to obtain a sufficient yield ratio after the aging, and the end face cracking occurred due to the effect of impact.

In Sample No. 35, the C content was too small, to thus fail to obtain a sufficient tensile strength. In Sample No. 36, because of the C content being excessive, the area fraction of the retained austenite was excessive and the end face cracking occurred due to the effect of impact. In Sample No. 37, the Si content was too small, to thus fail to obtain a sufficient tensile strength, and further the yield strength did not increase very much even by the aging to then fail to obtain a sufficient yield ratio after the aging. In Sample No. 38, because of the Si content being excessive, the area fraction of the ferrite and the area fraction of the retained austenite were excessive to fail to obtain a sufficient yield ratio after the aging. In Sample No. 39, because of the Mn content being too small, the area fraction of the ferrite was excessive, it was impossible to obtain a sufficient yield ratio after the aging, and the end face cracking occurred due to the effect of impact. In Sample No. 40, because of the Mn content being excessive, the total area fraction of the ND//<111> orientation grains and the ND//<100> orientation grains was excessive and the end face cracking occurred due to the effect of impact. In Sample No. 41, because of the Al content being excessive, the area fraction of the ferrite was excessive to fail to obtain a sufficient yield ratio after the aging. In Sample No. 42, because of the N content being excessive, the end face cracking occurred due to the effect of impact and the yield point elongation became excessive. In Sample No. 43, because of the P content being excessive, the end face cracking occurred due to the effect of impact. In Sample No. 44, because of the S content being excessive, the end face cracking occurred due to the effect of impact. In Sample No. 45, because of the Ti content being excessive, the end face cracking occurred due to the effect of impact. In Sample No. 46, because of the Nb content being excessive, the end face cracking occurred due to the effect of impact.

With a focus on the manufacturing method, in Sample No. 2 and Sample No. 19, because the start temperature and the finishing temperature of the finish rolling were low, the total area fraction of the ND//<111> orientation grains and the ND//<100> orientation grains became excessive. In Samples No. 4 and No. 18, because of the finish rolling finishing temperature being low, the total area fraction of the ND//<111> orientation grains and the ND//<100> orientation grains became excessive. In Samples No. 5 and No. 20, because of the first average cooling rate being high, the total area fraction of the ND//<111> orientation grains and the ND//<100> orientation grains became excessive. In Samples No. 6 and No. 21, because of the second average cooling rate being low, the content of solid-solution C became too small. In Samples No. 7 and No. 22, because of the coiling temperature being high, the content of solid-solution C became too small. In Samples No. 8 and No. 23, because of the maximum attained temperature of the annealing being low, the area fraction of the ferrite became excessive and the total area fraction of the ND//<111> orientation grains and the ND//<100> orientation grains became excessive. In Samples No. 9 and No. 24, because of the third average cooling rate being low, the area fraction of the ferrite became excessive and the content of solid-solution C became too small. In Samples No. 10 and No. 25, because of the fourth average cooling rate being low, the content of solid-solution C became too small. In Samples No. 11 and No. 26, because of the holding temperature of the reheating being low, the area fraction of the first martensite became too small. In Samples No. 14 and No. 27, because of the holding time period of the reheating being short, the area fraction of the first martensite became too small. In Sample No. 17, because of the reheating not being performed, the area fraction of the first martensite became excessive.

INDUSTRIAL APPLICABILITY

The present invention can be utilized for the industries relating to a steel sheet suitable for an automotive vehicle body, for example.

The invention claimed is:

1. A steel sheet, comprising:

a chemical composition represented by, in mass %,

C: 0.05% to 0.40%,

Si: 0.05% to 3.0%,

Mn: 1.5% to 3.5%,

Al: 1.5% or less,

N: 0.010% or less,

P: 0.10% or less,

S: 0.005% or less,

Nb: 0.00% to 0.04%,

Ti: 0.00% to 0.08%,

V and Ta: 0.0% to 0.3% in total,

Cr, Cu, Ni, Sn, and Mo: 0.0% to 1.0% in total,

B: 0.000% to 0.005%,

Ca: 0.000% to 0.005%,

Ce: 0.000% to 0.005%,

La: 0.000% to 0.005%, and the balance: Fe and impurities; and a steel structure represented by, in area %, first martensite in which two or more iron carbides each having a circle-equivalent diameter of 2 nm to 500 nm are contained in each lath: 20% to 95%, ferrite: 15% or less, retained austenite: 15% or less, and the balance: bainite, or second martensite in which less than two iron carbides each having a circle-equivalent diameter of 2 nm to 500 nm are contained in each lath, or the both of these, wherein the total area fraction of ND//<111> orientation grains and ND//<100> orientation grains is 37% or less, the content of solid-solution C is 0.44 ppm or more, the ND//<111> orientation grain is a crystal grain having a crystal orientation parallel to the normal direction of a sheet surface being a crystal orientation having a deviation from the <111> direction of 10° or less, and the ND//<100> orientation grain is a crystal grain having a crystal orientation parallel to the normal direction of the sheet surface being a crystal orientation having a deviation from the <100> direction of 10° or less.

2. The steel sheet according to claim 1, wherein in the chemical composition, V and Ta: 0.01% to 0.3% in total is established.

3. The steel sheet according to claim 1, wherein in the chemical composition, Cr, Cu, Ni, Sn, and Mo: 0.1% to 1.0% in total is established.

4. The steel sheet according to claim 1, wherein in the chemical composition, B: 0.0003% to 0.005% is established.

5. The steel sheet according to claim 1, wherein one or more of:

Ca: 0.001% to 0.005%,

Ce: 0.001% to 0.005%, and

La: 0.001% to 0.005%, are contained in the chemical composition.

* * * * *